United States Patent [19]

Spies et al.

[11] Patent Number: 5,028,750

[45] Date of Patent: Jul. 2, 1991

[54] IMPACT SENSOR

[75] Inventors: Hans Spies, Pfaffenhofen; Alfons Woehrl, Schrobenhausen; Horst Laucht, Bruckmuehl, all of Fed. Rep. of Germany

[73] Assignee: Messerschmitt-Boelkow-Blohm GmbH, Munich, Fed. Rep. of Germany

[21] Appl. No.: 427,087

[22] PCT Filed: Dec. 15, 1988

[86] PCT No.: PCT/EP88/01160

§ 371 Date: Oct. 23, 1989

§ 102(e) Date: Oct. 23, 1989

[87] PCT Pub. No.: WO89/07830

PCT Pub. Date: Aug. 24, 1989

[30] Foreign Application Priority Data

Feb. 9, 1988 [DE] Fed. Rep. of Germany ..... 3803914

[51] Int. Cl.[5] ..... H01H 35/14; H01H 9/00

[52] U.S. Cl. ..... 200/61.45 M; 335/205

[58] Field of Search ..... 200/61.45 R, 61.45 M, 200/61.53; 335/205

[56] References Cited

U.S. PATENT DOCUMENTS 3,459,911 8/1959 Fischer ..... 200/61.45 R 3,743,849 7/1973 Iwata ..... 200/61.45 M X 3,748,415 7/1973 Suzuki ..... 200/61.45 M X

FOREIGN PATENT DOCUMENTS 1590743 5/1970 Fed. Rep. of Germany .

2158800 5/1972 Fed. Rep. of Germany .

3338287 5/1985 Fed. Rep. of Germany .

426424 1/1983 Sweden .

*Primary Examiner*—J. R. Scott

*Attorney, Agent, or Firm*—W. G. Fasse; D. H. Kane, Jr.

[57] ABSTRACT

A magnetic impact sensor for motor vehicles with a safety system such as an airbag or belt tensioner for an occupant restraint system, has a circuit breaker arranged in an electrical trigger circuit of the safety system for inflating the airbag or tightening the belt by closing the trigger circuit in response to an acceleration or deceleration effective beyond a prescribed time duration. For this purpose a magnet in combination with specially shaped pole pieces forms two magnetic circuits the magnetic conductances of which are influenced by the position of a ferromagnetic ball that moves in response to an impact relative to the pole pieces to thereby open or close the circuit breaker. Normally, in the absence of an impact the ball is in a first position that keeps the circuit breaker open. When an impact occurs the ball moves into a second position to close the circuit breaker and thus the trigger circuit.

6 Claims, 2 Drawing Sheets

IMPACT SENSOR

FIELD OF THE INVENTION

The invention relates to an impact sensor with a magnet which is especially usable for safety devices such as an airbag in motor vehicles.

BACKGROUND INFORMATION

An acceleration sensor is, for example, described in the German Patent Publication DE 2,158,800. When an acceleration force arises, a spherical ball which in its resting position is attracted by a permanent magnet, is moved away from the magnet by overcoming the attraction force for activating a switching operation. It is disadvantageous that the switch is a microswitch with an actuating push rod loaded by a spring force. In order to overcome the disadvantages of using springs in such systems, it has also already been recommended in German Patent Publication DE-3,338,287 to use a permanent magnet system in an acceleration sensor which comprises two permanent magnets facing each other with the same sign poles and which are slideably arranged in the direction of their lengthwise axes. The permanent magnets are ring magnets within which a reed switch is arranged. With such an arrangement perhaps one can avoid using springs. However, operating conditions for the reed switch are most difficult in practice; especially bouncing of the contacts is frequent.

SUMMARY OF THE INVENTION

It is the object of the invention to provide a magnetic impact sensor for safety devices, which functions exactly according to a structurally given characteristic, even under difficult application and switching conditions and which achieves its proper function over a long working life.

This object has been achieved by an impact sensor according to the invention, wherein the impact sensor has at least one magnet which forms with its respectively shaped pole pieces two magnetic circuits magnetically connected in parallel with each other. The magnet is, for example, a permanent magnet. The magnetic pole pieces form a housing in which a ferromagnetic ball can move in response to impact forces to respectively influence one or the other magnetic circuit to thereby open or close a reed contact of a reed relay switch which is, for example, connected in a trigger circuit for activating a passenger safety device in a vehicle. The ball moves perpendicularly to the longitudinal orientation of the reed contacts, whereby the ball, in each of its end positions positively influences the respective magnetic circuit either to short circuit one of the two parallel magnetic circuits or to positively close the reed contacts

BRIEF DESCRIPTION OF THE DRAWINGS

An example embodiment of the invention is purely schematically

DETAILED DESCRIPTION OF PREFERRED EXAMPLE EMBODIMENTS AND OF THE BEST MODE OF THE INVENTION

Figure 1:
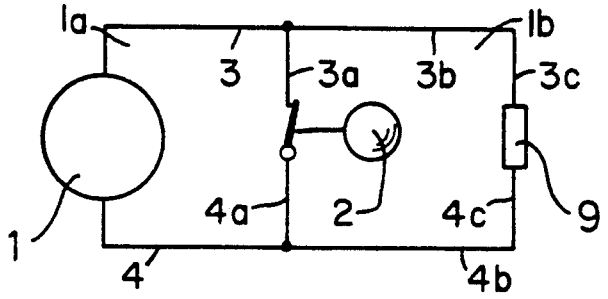
FIG. 1 shows two parallel magnetic circuits formed according to the invention.
Figure 1A:
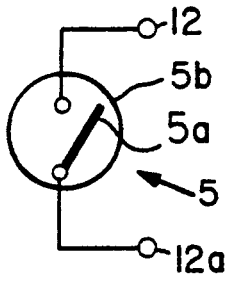
FIG. 1*a* shows an electric reed switch arranged to be operated by the magnetic circuits of FIG. 1.

Referring to FIG. 1 the present impact sensor comprises a permanent magnet 1 and two soft magnetic circuits 1*a* and 1*b* normally connected in parallel with each other and having different magnetic resistances or conductances 8 and 9. The magnetic circuit with the lower magnetic resistance 8 is normally closed by a spherical ferromagnetic ball 2 which normally stays in a first position when there is no impact. The ball 2 is subject to gravity and also can move in response to impact forces. Under the effects of an acceleration or deceleration caused by impact forces over a defined time, the ball 2 moves out of its initial first position, whereby the magnetic resistance increases sharply. Thus, the magnetic potential rises and a reed relay 5 shown in FIG. 1*a* located in the circuit having the higher magnetic resistance 9 and acting as a magnetically activated turn-on switch, closes its reed contacts 5*a* connected at 12, 12*a* to a trigger circuit for turning on a safety device not shown. If the effect of the external impact forces stops, then the spherical ball 2 is again pulled back or reset into the initial position by the magnetic field of the magnet 1. This resetting may be supported by a reset spring not shown. The reed delay 5 again assumes the original switching position shown in FIG. 1*b* in which the reed contacts 5*a* are open as shown in FIG. 1*a*. The reed relay 5 has its contacts 5*a* inside a glass jacket 5*b*.

Figure 1B:
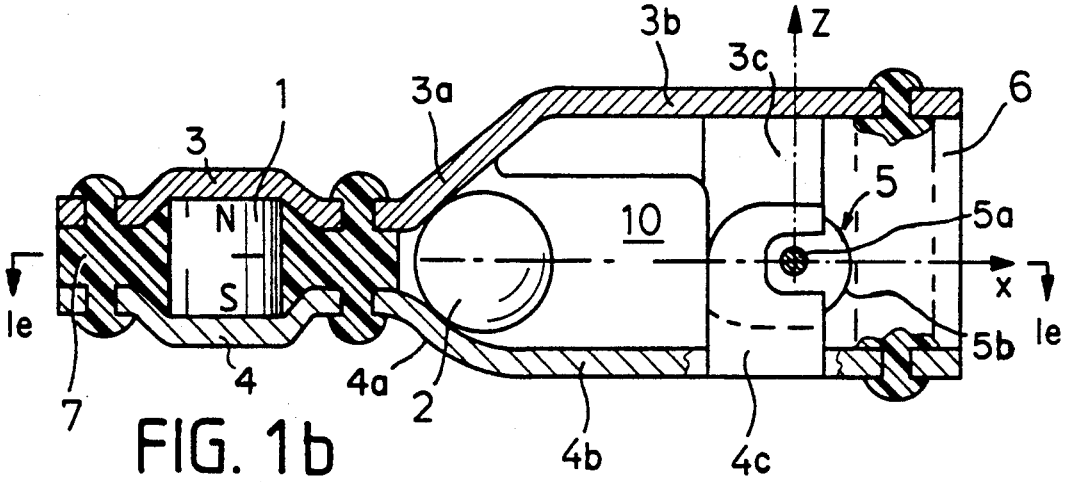
FIG. 1*b* is a lengthwise section through a sensor housing enclosing a free space in which a mass in the form of a spherical ball is movable in response to acceleration.

FIG. 1*b* shows the construction of the magnetic impact sensor of the invention. The response characteristic may be influenced by shaping the free space 10 for the ball 2 in the x-y-plane and in the Z-direction. Shaping in the x-y-plane involves, for example, a circular segment 10*a* shown in FIG. 1*c*. Shaping is also possible or necessary in the z-direction by an elliptical segment. The response threshold, the response sensitivity, and the switch-on duration must be substantially adapted to the desired values by means of the structural details. A high reliability, for example, in the trigger circuit of an airbag system, a belt tensioner or similar known safety systems, is achieved with the reed relay 5 which assures the electrical contact closing.

Referring further to FIG. 1*b* the magnet 1 has a north pole N in magnetic contact with a magnetic pole piece 3, and a south pole S in contact with a pole piece 4. The pole pieces 3 and 4 are held together by an electrically and magnetically non-conducting element 7. The above mentioned magnetic circuit 1*a* is formed by the pole piece 3, a slanted pole piece element 3*a*, through the ball 2 in its shown normal position, through a slanted pole piece element 4*a*, and the pole piece 4, back to the magnet 1. In the shown normal position the ball 2 forms substantially a magnetic short circuit, which is shown symbolically in FIG. 1 as a closed switch representing the magnetic conductance 8. The second magnetic circuit includes the ferromagnetic pole piece elements 3, 3a, 3b, 3c, the ball 2, and ferromagnetic pole piece elements 4c, 4b, 4a, 4. The ball 2 is closing the second magnetic circuit only in response to an impact force to influence the magnetic conductance 9. The elements 3b and 4b are held together by an electrically and magnetically nonconducting housing section 6 which encloses an inner chamber forming the above mentioned free space 10 for the ferromagnetic ball 2, for example, in the shape of a spherical ball. The above mentioned pole piece elements 3, 3a, 3b, 3c, and 4c, 4b, 4a, 4 form part of a housing and are all made of ferromagnetically conducting sheet metal.

The reed switch 5 is supported in the electrically and magnetically non-conducting section 6 between pole piece elements 3c and 4c forming magnetic yoke plates.

Figure 1C:
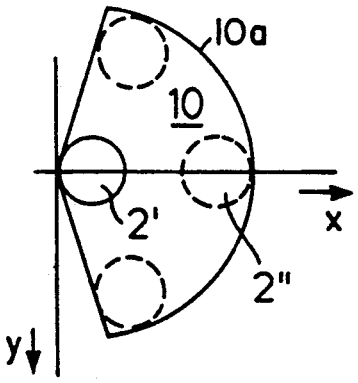
FIG. 1*c* is a top view onto another free space, wherein the spherical ball is free to move in response to acceleration.

Referring to FIG. 1c, the characteristic curve of the magnetic force effect on the ball 2, is substantially freely influenced by the shape of the free space in the housing in which the ball 2 can move. The shape of the inner housing walls in FIG. 1c is substantially semi-circular to enclose a respective free space 10a which also determines the boundaries of the motion of the ball 2 out of its normal first or rest position 2' between the pole piece extensions 3a and 4a close to the magnet 1, into the switching position 2'' close to the reed relay 5 with reed contacts 5a. In the latter position, the ball 2 is located temporarily between the pole piece elements 3c and 4c, forming magnetic yoke plates in the second magnetic circuit 1b.

The magnetic yoke plates 3c and 4c in FIG. 1b are arranged behind one another to the extent to which they overlap each other, whereby the yoke plate 4c partly covers the yoke plate 3c. FIG. 1e shows the arrangements of the respective elements in FIG. 1b sectioned along section line 1e—1e.

Figure 1D:
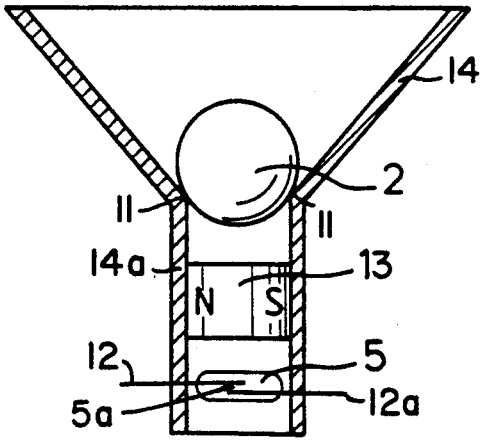
FIG. 1*d* shows a modification of the present sensor with a funnel shaped housing for enclosing a free space in which the spherical ball is free to move in response to acceleration, whereby the free space is shaped for using gravitational force for resetting the ball in addition to the magnetic force and for a characteristic substantially determined by the funnel shape.
Figure 1E:
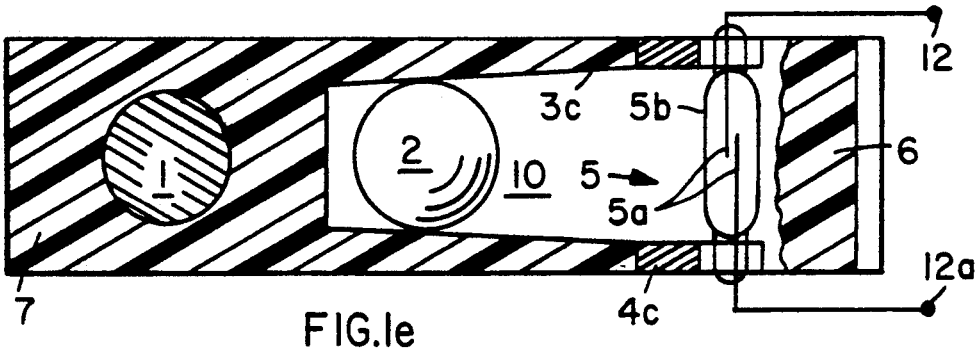
FIG. 1*e* is a sectional view along section line 1*e*—1*e*

FIG. 1d shows a modification in which a magnet 13 having a north pole N and a south pole S, as in FIG. 1b, is located next to a resting seat 11 formed at a transition between a conical housing section 14 and a tubular housing section 14a. The same ferromagnetic ball 2 as in the other Figures is normally held in the resting seat 11 by the force of the magnet 13. However, in FIG. 1d the magnet 13 is arranged in the tubular housing section between the resting seat 11 for the ball 2 and the reed relay 5. When the ball 2 is in the seat 11 due to the magnetic attractive force and due to the force of gravity the contacts 5a of the reed relay 5 are open as shown. When the ball 2 is forced out of the seat 11 by an impact force, the contacts 5a close, because now the magnetic circuit through the reed contacts 5a offers a lower magnetic resistance than is present when the magnetic field lines can pass through the ball 2 in its resting position in the seat 11. When the impact force ceases, the ball will automatically be restored in its resting position and the contacts 5a open again.

Although the invention has been described with reference to specific example embodiments, it will be appreciated, that it is intended to cover all modifications and equivalents within the scope of the appended claims.

We claim:

1. A magnetic impact sensor, comprising a sensor housing (6,7) a reed relay mounted in said sensor housing and having at least two reed contacts, magnet means (1) for operating said reed contacts, said magnet mean shaving a north pole (N) and a south pole (S), means operatively mounting said magnet means in said sensor housing ferromagnetic pole piece means (3, 3a, 3b, 3c; 4, 4a, 4b, 4c) for forming two magnetic circuits arranged in parallel to each other, a ferromagnetic mass (2) movable in response to an impact force in a free space (10) in said sensor housing, said ferromagnetic pole piece means forming said first magnetic circuit through a first magnetic path (N, 3, 3a; 4a, 4, S) and through said ferromagnetic mass (2) when the latter is in a rest position in said first magnetic path while an impact force is absent, said ferromagnetic pole piece means also forming said second magnetic circuit through a second magnetic path (N, 3, 3a, 3b, 3c; 4c, 4b, 4a, 4, S) and through said ferromagnetic mass (2) when the latter is in a displaced position in said second magnetic path while an impact force is effective, said at least two reed contacts being normally open and extending substantially perpendicularly to a movement direction of said ferromagnetic mass (2), said reed relay being positioned in said second magnetic path, so that said normally open reed contacts are closed when said impact force is effective and open when said ferromagnetic mass is in said rest position while an impact force is absent.

2. The magnetic impact sensor of claim 1, wherein said free space in said housing means has an approximately semicircular horizontal cross-section.

3. The magnetic impact sensor of claim 1, wherein said pole piece means comprise two slanted sections (3a, 4a) forming a seat for said ferromagnetic mass (2) in its rest position, and two spaced yoke plates (3c, 4c) forming a gap in which said ferromagnetic mass is received when said mass is displaced by an impact force.

4. A magnetic impact sensor, comprising a magnet (13) having a north pole (N) and a south pole (S) arranged in a common plane, a housing having a conical housing section (14) and a tubular housing section forming a seat (11) where said conical housing section merges into said tubular housing section, a ferromagnetic mass (2) normally resting on said seat in the absence of an impact force, said magnet (13) being mounted in said tubular housing section, so that said common plane of said north and south poles extends in parallel to a plane defined by said seat (11), a reed relay (5) also mounted in said tubular housing section, so that reed contacts of said reed relay extend substantially in parallel to said common plane of said north and south poles, whereby said reed contacts of said reed relay are normally held open as long as said ferromagnetic mass (2) rests on said seat, and wherein said reed contacts are closed when said ferromagnetic mass (2) is removed from said seat in response to an impact force.

5. The magnetic impact sensor of claim 4, wherein said conical housing section (14) encloses a free space in which said ferromagnetic mass (2) is movable in response to an impact force.

6. The magnetic impact sensor of claim 4, wherein said magnet (13) is located in said tubular housing section between said seat (11) and said reed relay.

* * * * *

UNITED STATES PATENT AND TRADEMARK OFFICE

CERTIFICATE OF CORRECTION

PATENT NO. : 5,028,750

DATED : July 2, 1991

INVENTOR(S) : Hans Spies et al.

It is certified that error appears in the above-identified patent and that said Letters Patent is hereby corrected as shown below:

Claim 1, column 4, line 4, replace "mean" by --means--;

Claim 1, column 4, line 5, replace "shaving" by --having--;

Claim 1, column 4, line 7, after "housing" insert --,--.

Signed and Sealed this

First Day of December, 1992

*Attest:*

DOUGLAS B. COMER

*Attesting Officer*

*Acting Commissioner of Patents and Trademarks*